United States Patent [19]

Roll et al.

[11] 4,088,197

[45] May 9, 1978

[54] POWER TOOL

[75] Inventors: Karl Roll, Leinfelden; Alfred Hettich, Stetten; Hubert Stahl, Giengen; Werner Keil, Heidenheim, all of Germany

[73] Assignee: Robert Bosch GmbH, Stuttgart, Germany

[21] Appl. No.: 653,253

[22] Filed: Jan. 28, 1976

[30] Foreign Application Priority Data

Feb. 8, 1975 Germany ..... 2505393

[51] Int. Cl.[2] ..... B25D 23/145

[52] U.S. Cl. ..... 173/12; 192/150

[58] Field of Search ..... 173/12; 81/52.4 A; 64/29, DIG. 2; 192/150; 251/113, 289; 137/599

[56] References Cited

U.S. PATENT DOCUMENTS

| | | | |
|---|---|---|---|
| 1,913,003 | 6/1933 | Shaff | 173/169 X |
| 2,558,687 | 6/1951 | Krueger | 137/599 |
| 2,618,459 | 11/1952 | Forss | 251/113 |
| 2,818,593 | 1/1958 | Klingler | 251/289 X |
| 3,252,458 | 5/1966 | Krasberg | 137/599 UX |
| 3,320,771 | 5/1967 | Roethlisberger et al. | 64/27 NM |
| 3,515,251 | 6/1970 | Clapp | 173/12 X |
| 3,593,830 | 7/1971 | Clapp et al. | 81/52.4 A X |
| 3,710,873 | 1/1973 | Allen | 173/12 |
| 3,738,503 | 6/1973 | Wallis | 64/29 X |
| 3,811,513 | 5/1974 | Wezel et al. | 173/12 |
| 3,993,145 | 11/1976 | Findeli | 173/12 |

FOREIGN PATENT DOCUMENTS

| | | | |
|---|---|---|---|
| 726,804 | 3/1932 | France | 64/29 |
| 30,653 | 2/1885 | Germany | 251/113 |

*Primary Examiner*—Staab, Lawrence J.
*Attorney, Agent, or Firm*—Michael J. Striker

[57] ABSTRACT

A power tool includes a motor and a motor switch movable between on and off settings. A transmission connects the motor to the tool holder of the power tool. The transmission includes a torque-responsive clutch arrangement which transmits torque below a preselected value in a first manner and torque above the preselected value in a different and distinguishable second manner. The torque-responsive clutch means undergoes an automatic change of torque transmission manner in response to a rise of transmitted torque past the preselected value. A turn-off arrangement mechanically detects the automatic change of the manner in which the clutch arrangement transmits torque and in response thereto automatically moves the motor switch from the on to the off setting. An override device is activatable by the user of the power tool for mechanically preventing the automatic turn-off arrangement from turning off the motor.

19 Claims, 16 Drawing Figures

POWER TOOL

BACKGROUND OF THE INVENTION

The invention relates to a power tool, particularly a power screwdriver, preferably one having a built-in pneumatic motor, and provided with a turn-on switch, with a threshold-torque-responsive clutch for monitoring the torque being transmitted by the tool, and an automatic turn-off arrangement operative for turning off the drive motor in response to the reaching of the threshold torque, with the motor turn-off arrangement including a locking arrangement so designed as to be responsive to a part of the clutch which shifts in response to the transmission of a certain amount of torque and furthermore being coupled to a push rod connected with an activating device arranged for establishing or interrupting the supply of energy to the motor.

A power tool of the general type in question is disclosed in commonly assigned, copending application Ser. No. 631,187, now U.S. Pat. No. 4,006,785, of Karl Roll et al., filed Nov. 12, 1975 and entitled "POWER TOOL". The entire disclosure of which is incorporated herein by reference, and it meets successfully enough the objects set out for it. However, there are situations where it may be desired that the power tool motor not be automatically turned off when the threshold torque is reached, and that instead the power tool motor continue to run and drive the tool at a still higher torque.

SUMMARY OF THE INVENTION

It is an object of the invention to provide a power tool of the general type described above, or of a similar type, with a torque monitoring arrangement which can be deactivated or rendered ineffective when desired, with the torque-responsive clutch of the power tool transmission being so designed as to be capable of transmitting torque in excess of the threshold torque, even though the clutch exhibits a marked and well-defined response to transmission of the threshold torque.

These objects and others which will become clearer hereafter, can be met according to the invention by providing the work tool with a manually activatable override mechanism which is operative for preventing the threshold-torque-responsive motor-shut-off arrangement from interrupting the supply of energy to the power tool motor, with two distinguishable clutch actions being provided, one for torque transmission below the threshold torque and the other for torque transmission above the threshold torque. In this way, there is achieved the advantage that one and the same power tool can be used, as desired, to apply only a predetermined maximum torque or alternatively the highest torque which the drive motor of the power tool is capable of developing.

The override arrangement can be so designed as to include a blocking member which can at will be moved into a position in which it holds the aforementioned push rod in the position of the latter in which the activating device for the motor is turned on. The blocking member can be a pushbutton against which a collar on the push rod can abut. The override arrangement can alternatively include a holding slider and the activating device can be a valve member pressed by a valve spring against a valve seat, with the holding slider being slidable into a position in which it holds the valve member off the valve seat despite the opposition of the valve spring. The activating device can simultaneously serve as a turn-on switch. The override arrangement can be constructed as a second turn-on switch operative for connecting the power tool motor with its energy supply in a manner bypassing the activating device. Such second turn-on switch can be constructed in the form of a spring-biased valve. As one possibility, the motor can be connectable with its energy source by means of the combination of the first turn-on switch and the activating switch, on the one hand, or alternatively by means of the second turn-on switch. However, the tool can also be so constructed that the motor can be connected to its energy source for rotation in a first direction via the first turn-on switch and the activating device, and for rotation in a second direction via the second turn-on switch. If the two turn-on switches are used to control the direction in which the motor turns, then there can be provided a second override device by means of which the energy-supply-interrupting effect of the push rod can be overriden for the second rotation direction as well.

The second override arrangement can include a blocking member movable into a position holding the associated turn-on device in turned-on condition, through the intermediary of the push rod. The blocking member can be constructed as a pushbutton against which a collar on the push rod can be made to rest, so as to arrest the push rod. Finally, the second override device can include a holding slider, with the associated turn-on device being a spring-biased valve, the holding slider being movable into a position holding the valve member of the valve off its associated valve seat against the opposition of the valve spring.

It may be that the power tool will include a clutch comprised of a driving part coupled to the power tool motor and a driven part coupled to the accessory holder of the power tool and driven by the driving part in a manner dependent upon transmitted torque. The clutch may include a plurality of clutch bodies guided by one of the clutch parts for axial shifting but being held non-rotatable relative to such clutch part. The clutch bodies are confined between a member on one of the clutch parts and the other clutch part, with such other clutch part having a plurality of clutch body recesses accommodating the clutch bodies. The clutch body recesses are defined by sloping side walls, so that as the torque being transmitted by the clutch rises the clutch bodies climb up the sloping walls thereby effecting axial shifting of the aforementioned member. When the clutch arrangement has that structure, then it is particularly advantageous to make the supplemental clutch arrangement (the one transmitting torque above the threshold torque) unified with the main clutch arrangement (the one transmitting torque below the threshold torque). In such event, the sloping surfaces can be designed to serve as parts of the supplemental clutch arrangement, with each one having a summit line which is slipped over by a climbing clutch body when the threshold torque is reached, after which the next such sloping surface is impinged upon by the falling over clutch body. Such a construction of the clutch has the advantage that the torque-dependent clutch, after the threshold torque is reached, operates in the notch-jumping mode, in the sense that brief intervals of torque transmission alternate with brief intervals of substantially zero torque transmission. During the intervals of substantially zero torque transmission, the drive motor speed can build up, so that when torque transmission is abruptly recommenced there will be transmitted a torque impulse considerably in excess of the average torque being transmitted and considerably in excess of the threshold torque. Although the average torque may even decrease in this situation, the development of the higher torque peaks can be of considerable usefulness, for example for effecting the final little tightening of tightened screws.

When the clutch arrangements for transmitting torque below and thereafter above the threshold torque are combined into a single construction, then it is possible to speak either in terms of two clutch arrangements having some shared structure or else in terms of a single clutch arrangement having two modes of torque transmission.

Another expedient contemplated according to the invention is to use a distinct supplemental clutch arrangement for bypassing the main or torque-responsive clutch arrangement. If this is done, then it is preferred to make the supplemental clutch arrangement a claw clutch. Advantageously, the claw clutch is so designed that the clutch part which non-rotatably but axially shiftably guides the clutch bodies (e.g., clutch balls) is provided with cut-outs whose bounding surfaces move into engagement with claws arranged on the other clutch part in response to reaching of the threshold torque. With such a construction of the clutch, the power screwdriver, after it begins to transmit torque in excess of the threshold torque, acts as a standstill or stall screwdriver, i.e., a screwdriver which is brought to a stop by the increasing load torque applied to it.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
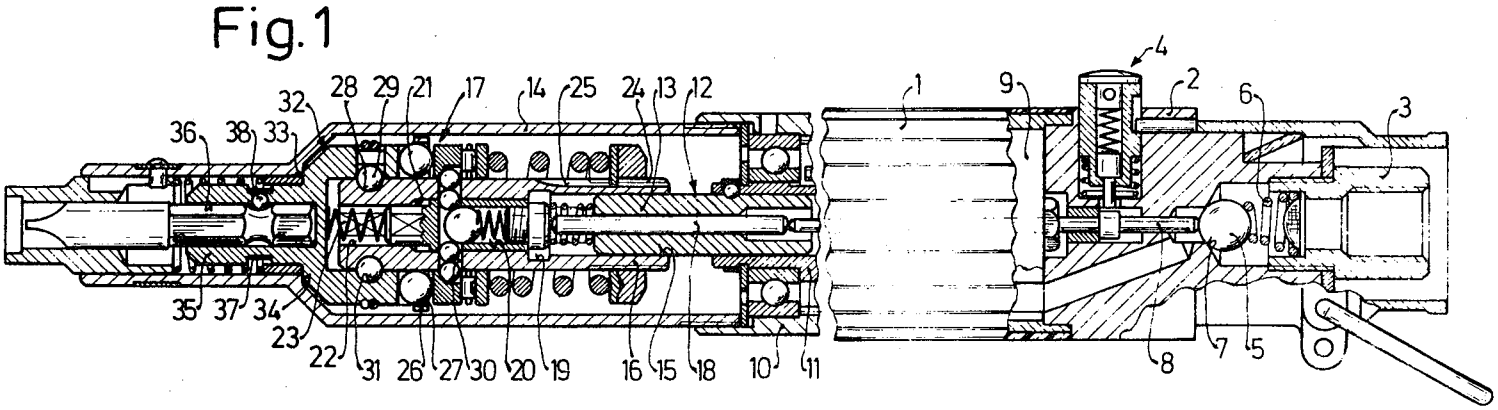
FIG. 1 depicts a push-to-start power screwdriver provided with an override pushbutton, with the screwdriver in the inoperative condition, and with the override pushbutton not activated.
Figure 1A:
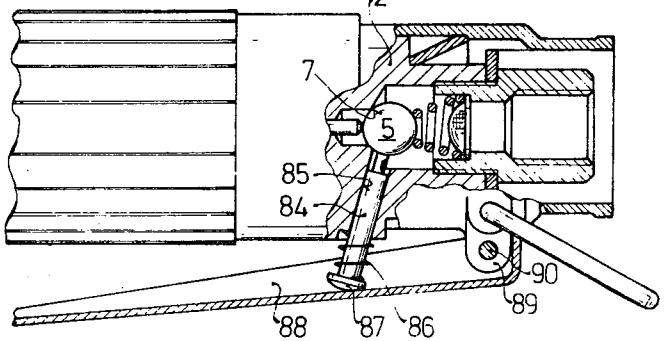
FIG. 1a depicts another push-to-start power screwdriver provided with an override holding slider, with the screwdriver in the inoperative condition, and with the override holding slider not activated (corresponding to the condition of the screwdriver shown in FIG. 1)

The power screwdriver of FIGS. 1 - 5 is comprised of a motor housing 1 and a valve housing 2. The valve housing 2 is provided with a threaded air connector member 3 and a manually activatable override arrangement 4. Arranged inside the valve housing 2 is an activating device here in the form of an activating valve. The activating valve includes a valve ball 5 made of elastic meterial and a conical compression spring 6. Conical compression spring 6 normally urges the valve ball 5 into closed position against the valve seat 7. Valve ball 5 can be pushed rightward off the valve seat 7 by means of a push rod 8.

Arranged in motor housing 1 is a per se conventional pneumatic sliding-vane motor 9 the rotor of which is provided with a central coaxial through-bore for the guidance of the push rod 8. The pneumatic motor 9 and its operation need not be further described.

A pipe-shaped transmission housing 10 is screwed into the motor housing 1. Transmission housing 10 contains a two-stage planetary-gear transmission. The second planet carrier 11 is connected with an intermediate shaft 12 non-rotatable and non-shiftable (i.e., in axial direction) relative to the latter. The forward end 13 of the intermediate shaft 12 is of hexagonal configuration. The two planet carriers and the intermediate shaft 12 are provided with central coaxial through-bores. These throughbores accommodate and guide push rod 8, and also an equalizing rod 18 which serves to lengthen the distance over which force can be transmitted axially via the push rod 8.

The forward end 13 of the intermediate shaft 12 projects into a pipe-shaped clutch housing 14 the rear end of which is screwed into the front end of transmission housing 10. The hexagonal front end of the intermediate shaft 12 is guided in the hexagonal recess 15 at the rear end of a sleeve-shaped driving part 16 of a clutch 17, so that intermediate shaft 12 and driving part 16 will be non-rotatably connected together. The push rod 8 terminates inside the intermediate shaft 12. The equalizer rod 18 is arranged in the central bore of the intermediate shaft 12, forward of and aligned with the push rod 8.

The driving part 16, forward of the hexagonal recess therein, has a widened transitional bore 19, and forward of bore 19 is a smaller-diameter cylindrical bore 20. The latter terminates with a shoulder 21. Forward of shoulder 21, the internal bore of the driving part 16 terminates with a bore 22 having two guide surfaces 23.

Externally, the driving part 16 is of generally cylindrical form. In the vicinity of its rear end it is provided with an external thread 24 interrupted by a longitudinal groove 25. The cylindrical body of driving part 16, in the vicinity of its internal shoulder 21, is provided with an integrally formed external flange 26. Flange 26 is provided with a plurality of axially extending bores 27 uniformly distributed in the circumferential direction. Forward of flange 26, there is formed in the cylindrical external surface of driving part 16 a circumferentially complete groove 28. Received within this circumferential groove 28 are the balls of a radial-axial bearing 29; about one half of each ball is accommodated in groove 28. Rearward of the shoulder 21 the driving part 16 is provided with a radially extending transverse through-bore 30.

The radially outer halves of the balls of the radial-axial bearing 29 are guided in an internal circumferential groove 31 of a driven part 32 of the clutch 17. The rear end of driven part 32 has the form of a cylindrical portion which surrounds the front end of driving portion 16. The driven part 32, with its forward end face 33, can press against a corresponding internal shoulder 34 of the clutch housing 14, i.e., when the transmission is in the non-retracted position of for example FIG. 1, in contrast to the retracted position of for example FIG. 3. Forward of its front end face 33, the driven part 32 terminates in an integrally formed tool holder 35. Too holder 35 is provided with an internal hexagonal recess for receiving the hexagonal rear end of a tool, for example one screwdriver from a set of screwdriver attachments. To retain the inserted tool against axial withdrawal, the tool holder 35 is provided with click balls 38 which are biased by an annular spring 37 into an annular recess in the rear end of the inserted tool.

Driven part 32 has a rear end face 39 which encircles driving part 16. Rear end face 39 is provided with a plurality of clutch ball recesses 41. Clutch ball recesses 41 are defined by inclined surfaces 40. The two adjoining inclined surfaces 40 of two adjoining clutch ball recesses 41 together define a radially extending summit line. The clutch ball recesses 41 accommodate clutch balls 42 which are each guided in a respective one of the axially extending bores 27 in the flange 26 of the driving part 16. Clutch balls 42 are pressed forward into the clutch balls recesses 41 by an axially shiftable clutch part, here having the form of a pressure ring 43. The front and rear end faces of pressure ring 43 are flat annular faces. Its outer surface is cylindrical. Its interior surface is composed of two component surfaces. The forward component surface 44 is a coaxial cylinder. The rearward component surface 45 is a forwardly converging truncated cone. Conical surface 45 acts as a cam surface, for converting axial shifting movement into radial shifting movement, in a manner described below.

Pressing against the rear end face of the pressure ring 43 is a needle bearing 46 serving to axially support the pressure ring 43. Rearward of the needle bearing 46 is a pressure transmission ring 47, and rearward of the latter a compression spring 48. Compression spring 48 surrounds the cylindrical external surface of driving part 16, and is referred to hereinafter as the torque-limiting spring. At its rear end, torque-limiting spring 48 abuts against a support disk 49. Support disk 49 encircles the cylindrical exterior surface of the rear end of driving part 16, and it has a radially inward extending nose 50 which is received in the longitudinal groove 25 of driving part 16, to keep support disk 49 and driving part 16 non-rotatable relative to each other. The rear end face of support disk 49 is provided with raised arresting portions 51. The raised arresting portions 51 face corresponding recessed arresting portions 52 of a threaded nut 53. Nut 53 is threaded onto the external thread 24 of driving part 16.

Turning of nut 53 serves to vary the precompression of spring 48 and thereby adjust the force with which the clutch balls 42 are being pressed into the clutch ball recesses 41 of the driven part 32. The non-rotatability and axial shiftability of support disk 49, on the one hand, and the engagement between cooperating arresting portions 51, 52, on the other hand, assure that any torsion which develops the compression spring 48 will not be transmitted to adjusting nut 53, so that the setting of adjusting nut will remain reliably constant at the selected value. It will be appreciated that the setting of adjusting nut 53 determines the torque at which the torque-limiting action sets in.

Guided in the cylindrical bore 20 of the driving part 16 is a cylindrical locking bolt 54. The front end of locking bolt 54 has the form of a reduced-diameter pin 55 provided with two guide surfaces 56. The pin 55 engages in the bore 22 of the driving part 16 and prevents the locking bolt 54 from rotating relative to driving part 16, by virtue of the engagement between surfaces 56 and 23.

The locking bolt 54 has a radially oriented transverse through-bore 57 of the same diameter as the radially oriented transverse through-bore 30 of driving part 16. The two transverse through-bores 30 and 57 are normally in register (FIG. 1) but move out of register (FIG. 4) during the automatic torque-responsive motor shut-off, described below.

Communicating with the radial transverse through-bore 57 of the locking bolt 54 is a rearward extending central coaxial bore 58 provided at the rear end of locking bolt 54 with an internal screwthread 59. Bore 58 is closed off at its rear by a screw 60 screwed into the screwthread 59. The equalizer rod 18 terminates slightly rearward of the screw 60.

Intermediate the forward end of the reduceddiameter pin 55 of locking bolt 54 and the rear end face of the driven part 32 there is confined an axially oriented compression spring 61 (anti-retraction spring) which is weaker than the conical compression spring 6 of the activating valve 5. Guided in the registerable radial bores 57 of locking bolt 54 and 30 of driving part 16 are two outer locking balls 62 and radially inward of the latter two inner locking balls 63. These locking balls 62, 63 are normally urged radially outward by a deflector ball 64. The latter is guided in the central coaxial bore 58 of the locking bolt 54 and is pushed axially forward by a compression spring 65 (the locking spring), the rear end of which bears against the screw 60 in the locking bolt 54.

The manually activatable override arrangement 4 of the power screwdriver of FIGS. 1 – 5 includes a depressible cylindrical pushbutton 66 slidably guided in a radial bore 67 of the valve housing 2. Pushbutton 66 is provided with a longitudinal groove 68 of limited length into which projects a pin 69 which extends parallel to the screwdriver axis. The pin 69 prevents pushbutton 66 from rotating and limits its longitudinal movement. In the vicinity of a central coaxial longitudinal bore 70 of valve housing 2, through which bore the push rod 8 is shiftably guided, the radial bore 67 of the valve housing is decreased by a shoulder 71 which leaves open a small central throughpassage 72 which extends radially, considered relative to the screwdriver axis, and which furthermore opens into the central longitudinal bore of the valve housing 2. A compression spring 73 is confined intermediate the shoulder 71 and the depressible pin 66 and urges the latter radially outward.

Pushbutton 66 is provided with a longitudinal through-bore 74 the outer end of which is closed off by a forced-in plug 75 secured in place by means of a pin 76. Bore 74 ends with an annular shoulder 77 which leaves free a reduced-diameter through passage 78. Shiftably guided in bore 74 is an internal depressible pin 79. Confined intermediate the internal depressible pin 79 and the plug 75 is a compression spring 80 which urges pin 79 radially inward toward the screwdriver axis. The internal depressible pin 79, at the side thereof facing away from spring 80, is provided with a reduced-diameter extension 81 which extends through the through-passage 78 of pushbutton 66.

In the vicinity of the radial transverse bore 67, the longitudinal bore 70 of valve housing 2 has a widened portion 82. The push rod 8 has a collar 83 located in this widened portion 82. Widened portion 82 is connected via the through-passage 72 with the guide bore 67 for the pushbutton 66. Depending upon the setting of pushbutton 66, the extension 81 of internal depressible pin 79 will be located in the vicinity of the collar 83 on push rod 83, or outside this vicinity.

The power screwdriver of FIGS. 1 – 5 operates as follows:

In the starting or inoperative condition of the screwdriver (FIG. 1), the clutch 17, by means of its driving part 16, the inner locking balls 63, the locking bolt 54, the equalizer rod 18, the push rod 8, the activating valve 5, and the valve spring 5, is held biased in its forward end position. In this position, the front end face 33 of the driven part 32 of the clutch 17 bears against the internal shoulder 34 of the clutch housing 14.

Assuming that the tool received in tool holder 35 is a screwdriver, the screwdriver attachment will be pressed against the screw to be tightened. This causes all the structure connected to the screwdriver attachment — i.e., the whole transmission arrangement including clutch 17 — to be pushed rearward into a retracted position (see FIG. 3). This pushing back of the clutch 17 is performed against the resisting force of valve spring 6. As clutch 17 is pushed rearward, push rod 8 transmits force from the rearward moving clutch arrangement and pushes back valve ball 5 of its seat 7, thereby causing pneumatic motor 9 to start up. Because of this characteristic manner of initiating operation of the power tool motor, screwdrivers of this type are known as push-to-start screwdrivers. Motor 9, through the intermediary of the planetary transmission, turns intermediate shaft 12 and, by means of the latter, driving part 16 of clutch 17. As driving part 16 turns, its flange 26, by means of the clutch balls 42, transmits rotation to driven part 32 of the clutch 17.

Figure 4:
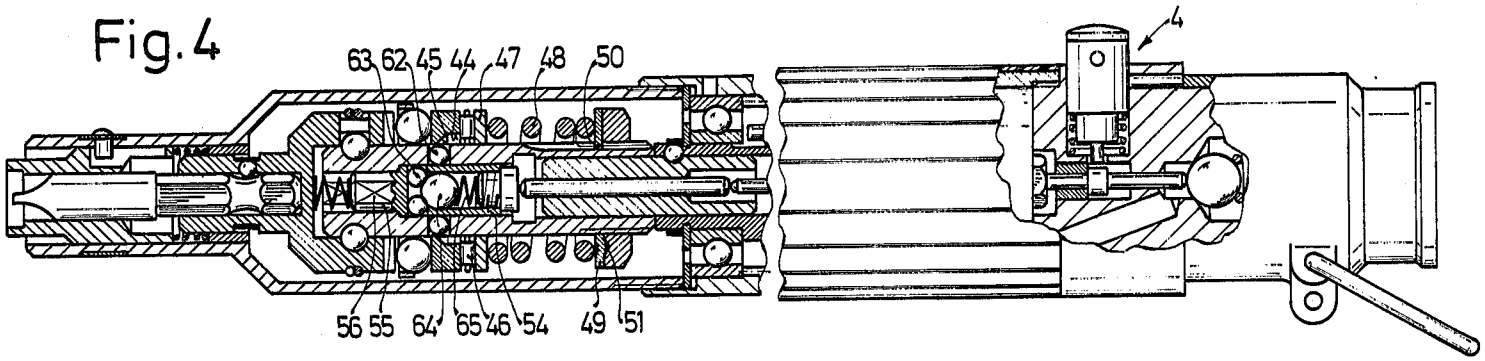
FIG. 4 depicts the screwdriver of FIG. 1 in the automatically turned-off condition, with the override pushbutton not activated.

If the screw has been tightened to such an extend that the torque being transmitted by the power screwdriver is approaching the value to which the nut 53 has been set, then, as shown in FIG. 4, the clutch balls 42 climb up (i.e., move rightward in the drawing) the sloping sides of the clutch ball recesses 41 in the rear end of the driven part 32. In so doing they rearwardly shift the pressure ring 43 against the increasing opposing force of the torque-limiting compression spring 48. As the pressure ring 43 is pressed back, its interior conical surface acts like a cam surface and drives the outer locking balls 62 radially inward into the radial through-bore 30 of driving part 16.

The inner locking balls move completely out of the radial through-bore 30 of driving part 16 and completely into the locking bolt 54, and in so doing push the deflector ball 64 axially rearward against the resisting force of locking spring 65.

As a result, the inner locking balls 63 can no longer exert any locking force; i.e., they no longer serve to lock together the locking bolt 54 and the driving part 16 for joint axial movement. The locking bolt 54 accordingly moves axially forward, moved by the force of valve spring 6 transmitted through the intermediary of push rod 8 and equalizer rod 18, and activating valve 5 closes. The inner locking balls 63 become entirely contained within the cylindrical longitudinal bore 22 of the driving part 16 (see FIG. 4). Meanwhile, the clutch balls 42 will have climbed up to the summits of the respective sloping surfaces and slipped over into the respective neighbouring ones of the clutch ball recesses 41. The closing of activating valve 5 terminates the supply of driving air to the motor 9, and the motor accordingly stops.

When the power screwdriver is pulled back away from the tightened screw, the anti-retraction spring 61 causes the driven part 32 and accordingly the whole clutch arrangement 17 to move forward into its forward end position. The anti-retraction spring 61, via locking bolt 54, equalizer rod 18, push rod 8 and valve ball 5, bears against valve spring 6. It is to be recalled that the valve spring 6 is stronger than the anti-retraction spring 61. As the clutch arrangement 18 moves axially forward towards its forward end position, the radial bore 30 slides into register with the radial bores 57 of the locking bolt; the locking spring 65 pushes the deflector ball 64 forward; and deflector ball 64 in moving forward pushes the inner locking balls 63 radially outward until, when the radial bores come into full register, the inner and outer locking balls 63 and 62 have resumed the starting positions shown in FIG. 1. The power screwdriver is now ready for another operating cycle. During the aforedescribed operating cycle, the pushbutton 66 of the override arrangement 4 was not activated but instead remained throughout in its radially outward end position.

Figure 2:
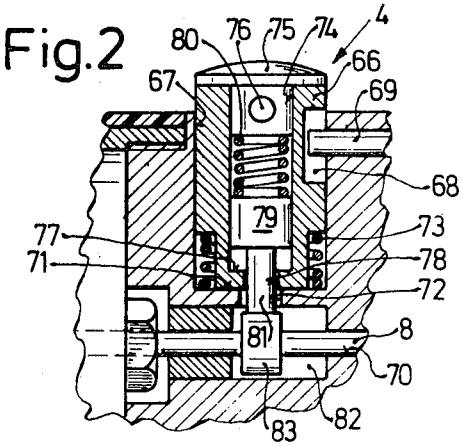
FIG. 2 is an enlarged view of the override pushbutton of the screwdriver of FIG. 1, activated.
Figure 3:
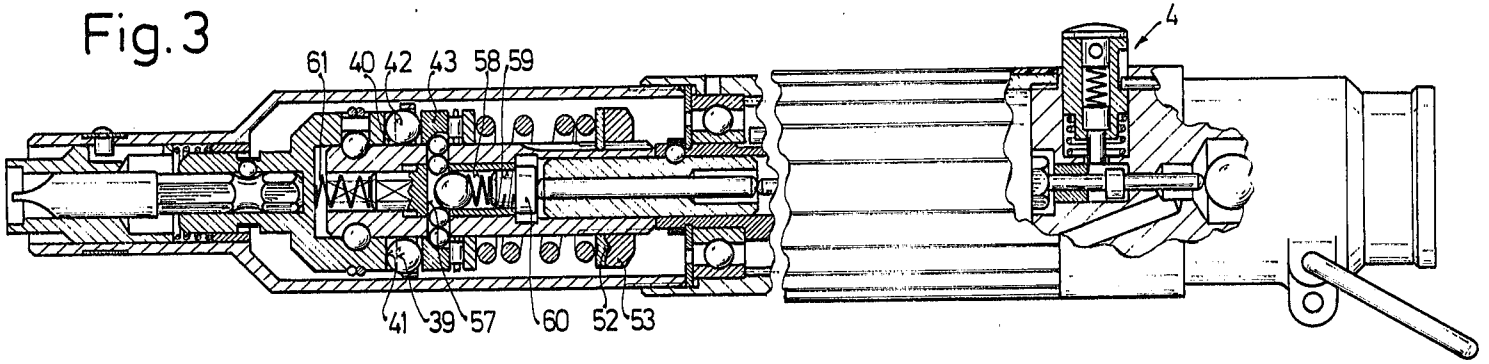
FIG. 3 depicts the power screwdriver of FIG. 1 in its operative condition, with the override pushbutton not activated.
Figure 5:
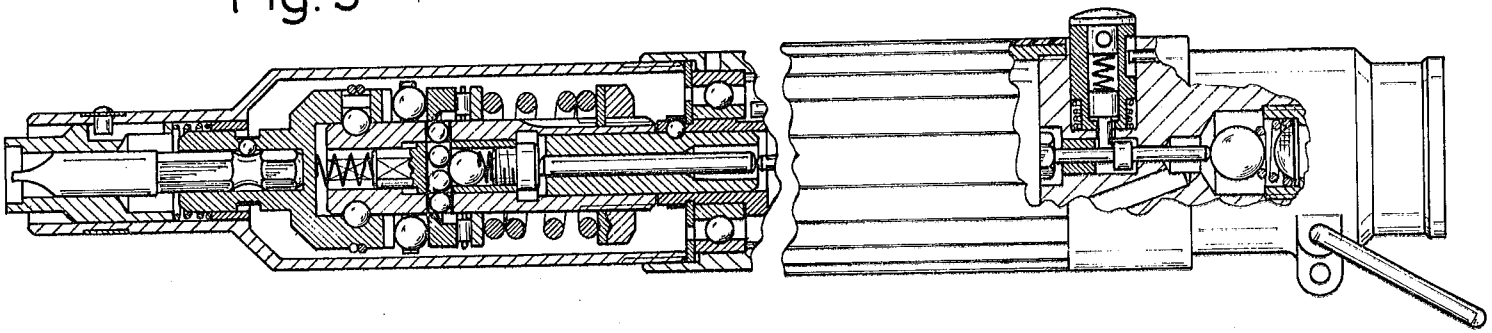
FIG. 5 depicts the screwdriver of FIG. 1 with its clutch arrangement running in the high-torque notch-jumping mode, with the override pushbutton activated.
Figure 5A:
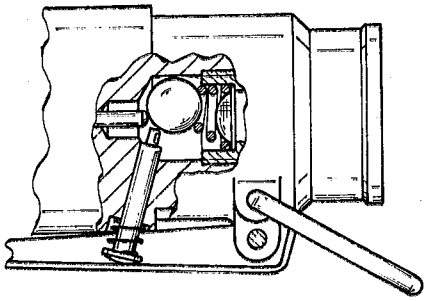
FIG. 5a depicts the screwdriver of FIG. 1a with its clutch arrangement running in the high-torque notch-jumping mode, and with its override holding slider activated (corresponding to the condition of the screwdriver of FIG. 5)
Figure 4A:
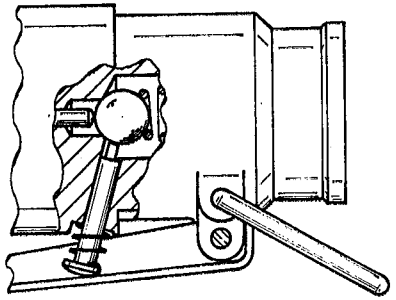
FIG. 4a depicts the screwdriver of FIG. 1a in the automatically turned-off condition, with the override holding slider not activated (corresponding to the condition of the screwdriver of FIG. 4)
Figure 3A:
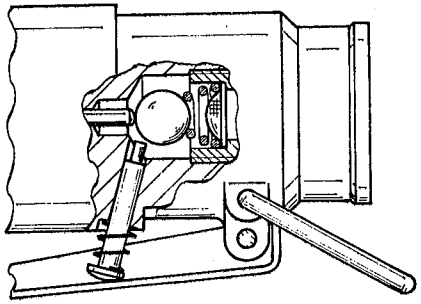
FIG. 3a depicts the power screwdriver of FIG. 1a in its operative position, with the override holding slider not activated (corresponding to the condition of the screwdriver shown in FIG. 3)

It may be desired that the power screwdriver not immediately cease to operate when the torque being transmitted by it reaches the threshold value. Instead, it may be desired that the screwdriver continue to operate, with each clutch ball 42 continually slipping over from one clutch ball recess 41 to the next. If so, the pushbutton 66 of the override arrangement 4 is pressed against the opposing force of spring 80 into its inner end position. If the screwdriver has not yet been placed in position against a screw to be tightened, so that the push rod 8 is still in its forward end position and the activating valve 5 accordingly still closed, then the extension 81 of the internal depressible pin 79 moves into abutment against the collar 83 of push rod 8 (FIG. 2). When the screwdriver is placed against a screw to be tightened and then pushed towards the screw, the push rod 8 slides into its rearward end position and opens activating valve 5. The collar 83 of the push rod 8 moves past the extension 81 of the internal depressible pin 79, and the latter is moved by the compression spring 80 into abutment against the push rod 8 forward of the collar 83 (FIG. 5).

If now the limit torque is reached, then, in the manner described before, the clutch balls 42 climb up the sloping walls 40 of the clutch ball recesses 41 and in so doing push pressure ring 43 axially rearward, thereby driving the locking balls radially inward until they no longer lock the locking bolt to the driving part of the clutch. However, even though the locking action of the locking balls is now removed, push rod 8 and equalizer rod 18 will not shift forward, because the collar 83 of push rod 8 is being held back by the extension 81. As a result, valve ball 5 does not move into its closed position, but instead remains in its open position for as long as pushbutton 66 remains depressed (FIG. 5).

FIGS. 1a, 2a, 3a, 4a, 5a depict a pneumatic screwdriver likewise designed as a push-to-start screwdriver, and provided with the same automatic motor-shut-off arrangement as employed in the screwdriver shown in FIGS. 1 – 5; for this reason, the automatic shut-off arrangement is not depicted again in FIGS. 1a – 5a. The manually activatable override arrangement, for preventing the push rod from permitting the activating valve to close, in the embodiment of FIGS. 1a – 5a is essentially comprised of a holding slider 84 guided in a bore 85 of the valve housing 2. A compression spring 86 is confined between the head 87 of the holding slider 84 and the outer wall of valve housing 2, and urges the holding slider 84 to its outer position. The axis of the holding slider 84 is oriented towards the valve ball 5 of the activating valve. Holding slider 84 is manually activatable by means of a lever 88 which is mounted for pivoting movement by means of an eye 89 on the valve housing and a mounting pin 90. It would be possible to omit lever 88 and instead manipulate holding slider 88 directly.

If upon reaching the limit torque the screwdriver is not to be automatically shut off but instead permitted to run on, with the clutch balls 42 of its clutch 17 continually migrating around the circle of clutch ball recesses 41 (notch-jumping torque-transmission mode), then the user squeezes the lever 88 to move the holding slider 84 into its inner end position. As a result the valve ball 5 is pushed off its seat 7 and the motor 9 starts up. It will be noted that if the holding slider 84 is activated, then the screwdriver will not operate as a push-to-start screwdriver, unless the screwdriver is pushed against the screw to start before the slider 84 is activated, and the motor will continue to run for as long as the lever 88 remains depressed. If during screwdriver operation the lever 88 is depressed, then the automatic turn-off arrangement will be in effect deactivated; even when the locking bolt 54 is released so that the push rod 8 no longer pushes the valve ball 5 off its seat 7, the holding slider 84 will continue to keep ball 5 in open position. During screwdriver operation in the notch-jumping mode of clutch operation, if the lever 88 is released, then compression spring 86 pushes the holding slider 84 away from the valve ball 5, valve spring 6 pushes ball 5 onto its seat 7 and pushes push rod 8 forward, because with the clutch continually running in the notch-jumping mode the inner locking balls do not afford a locking action.

Figure 6:
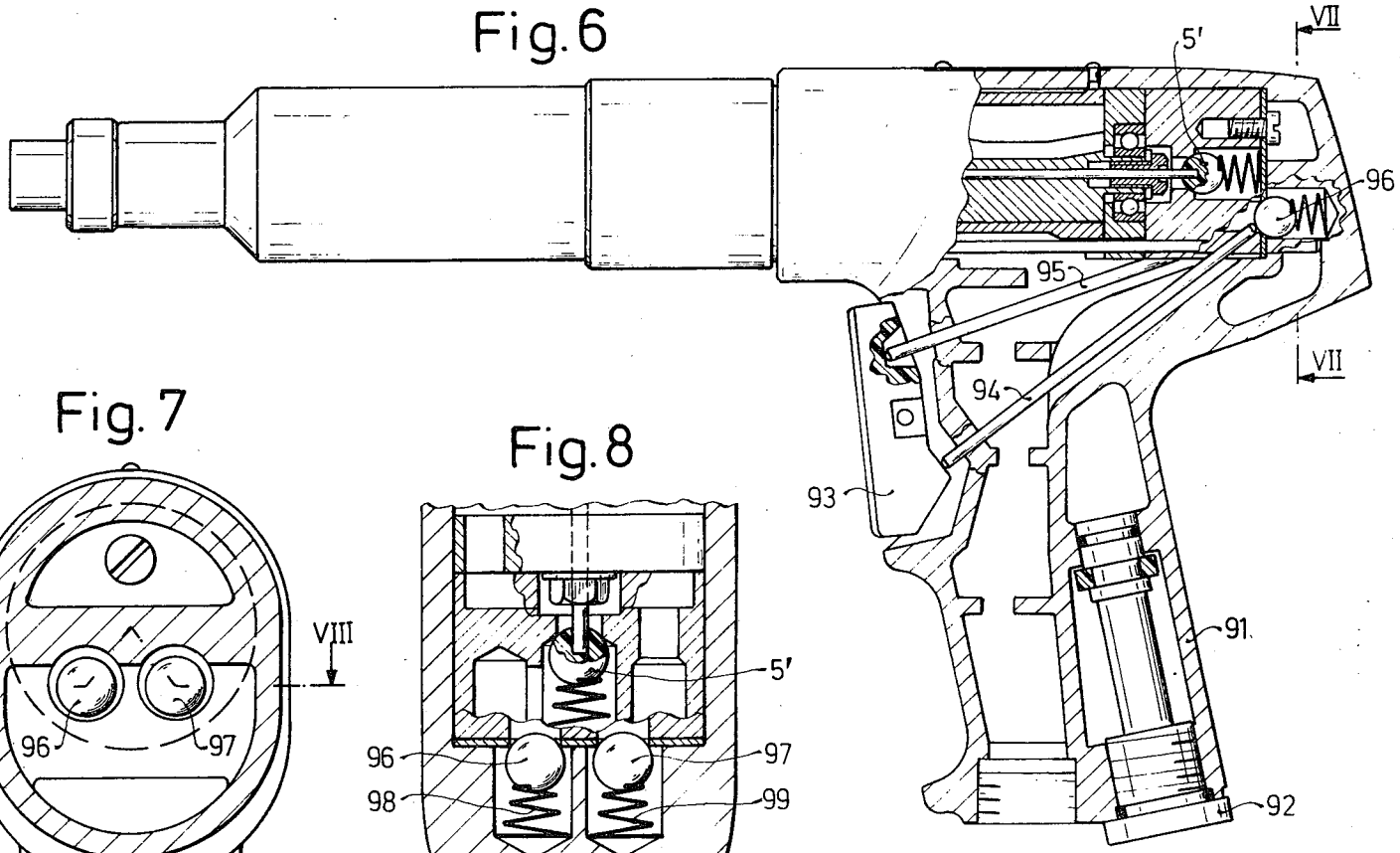
FIG. 6 depicts a power screwdriver having a piston grip and first and second turn-on devices.
Figure 8:
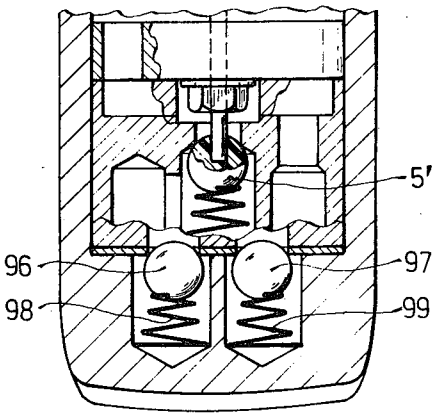
FIG. 8 is a section through the screwdriver of FIG. 6, taken on line VIII—VIII of FIG. 7.
Figure 7:
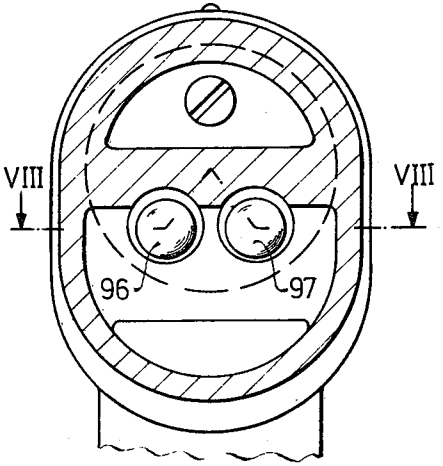
FIG. 7 is a section through the screwdriver of FIG. 6, taken on line VII—VII of FIG. 6.
Figure 10:
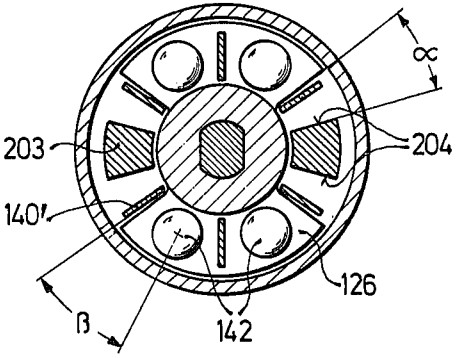
FIG. 10 is a section through the screwdriver of FIG. 9, taken on line X—X of FIG. 9.
Figure 12:
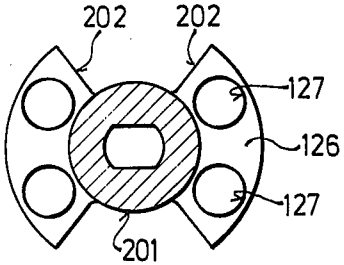
FIG. 12 depicts a detail of the structure shown in FIG. 10.
Figure 9:
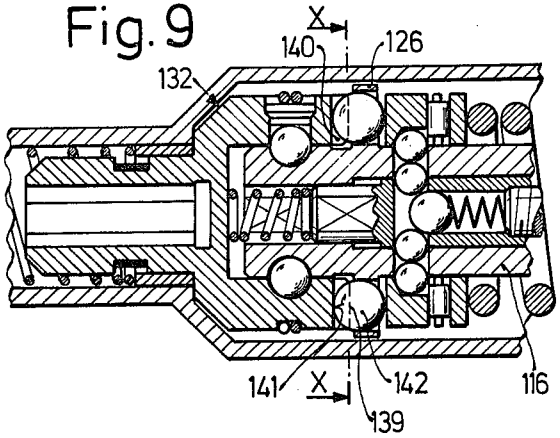
FIG. 9 depicts part of a power screwdriver provided with a supplemental clutch arrangement.
Figure 11:
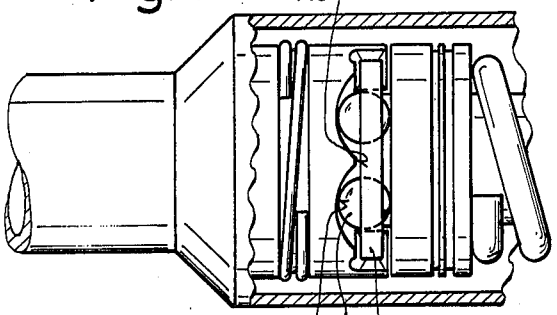
FIG. 11 is a partially sectioned side view of part of the screwdriver of FIG. 9.

A third embodiment is depicted in FIGS. 6, 7 and 8. This screwdriver includes the same automatic shut-off arrangement as the previously described embodiment, and is provided with a piston grip 91. A pressurized air connector 92 is arranged in the hand grip. A two-armed lever switch 93 activates the two valve push rods 94 and 95. The valve push rods each cooperate with a respective one of two turn-on valves 96, 97 biased by respective ones of compression springs 98, 99. Here the activating valve 5' constitutes a third valve.

The motor is connectable with the air inlet 92, either via the turn-on valve 96 through the intermediary of the activating valve 5', or alternatively via the second turn-on valve 97 directly. If the motor is energized using the turn-on valve 96, then the automatic turn-off arrangement will turn off the motor when the limit torque is reached. If the motor is energized using the turn-on valve 97, then, although the turn-off arrangement will be tripped, it will not turn off the motor, and the screwdriver will continue to operate, with the clutch in the high-torque notch-jumping mode. By differently designing the air conduits it is also possible to make the screwdriver motor turn in selectable opposite directions; for example the motor could turn rightwards when the motor energization is effected via turn-on valve 96, whereas it could turn leftwards when the motor energization is effected via activating valve 5', with turn-on valve 97 serving to bypass activating valve 5' for leftwards operation. Such a screwdriver could also be provided with an override arrangement for the push rod, for example as described above with a collar on the push rod cooperating with a pushbutton, or it could be provided with a holding slider for holding the valve member off its valve seat. The automatic torque-responsive motor shut-off action could then be prevented, whenever desired, for rightwards motor turning as well. As another alternative, two activating valves (such as 5') could be provided, one for each rotary direction, with each having its own associated override or bypass valve (such as 97).

An advantage of having the screwdriver continue to operate after the threshold torque has been reached, with the clutch arrangement of the screwdriver accordingly operating in the high-torque notch-jumping mode, is in that in this mode of clutch operation the transmitted torque is significantly increased. During the brief time intervals in which the clutch balls slip over from one clutch ball recess to the next, no torque is being transmitted; however, as the clutch balls then suddenly come to bear against the sloping sides of the next clutch ball recesses torque is suddenly transmitted again. During the brief interval in which little or no torque is being transmitted, the motor has the opportunity to speed up somewhat, so that when torque transmission is resumed the instantaneous torque will have a value considerably in excess of the average torque being transmitted during operation in the notch-jumping mode. In fact, although the average torque being transmitted in the notch-jumping mode may even have decreased, the maximum instantaneous torque being intermittently transmitted will have increased, and this higher torque, even if applied only intermittently, is useful for effecting the last little tightening of the screw to be tightened, for example.

However, instead of resorting to notch-jumping clutch operation, one can employ a separate supplemental clutch arrangement which becomes engaged after the threshold torque has been reached. FIGS. 9 – 12 depict an embodiment of this concept, in which the second clutch is a claw clutch. In FIGS. 9 – 12 components corresponding to those of FIGS. 1 – 8 are denoted by corresponding numerals increased by 100, whereas components not finding counterparts in FIGS. 1 – 8 are denoted by numbers greater than 200.

The driving part 116 of the clutch arrangement is provided with a flange 126 having two cutouts 201 forming circle sectors and each having an angular extent on the order of about 80°. The cut-outs 201 are bounded by radial surfaces 202. The two remaining, circlesector-shaped parts of the flange 126 each have two bores 127 in which clutch balls 142 are guided. The driven part 132 is provided with only four clutch ball recesses 141, arranged in pairs and, in assembled condition of the screwdriver, facing the bores 127. Intermediate the two pairs of clutch ball recesses 141, the rear end face 139 of the driven part 132 is formed with two claws 203, located diametrally opposite each other, with each claw 203 having two radial surfaces 204. The claws 203 project into the cut-outs 201 of flange 126. Their breadth is so dimensioned that the angle alpha (FIG. 10) intermediate one bounding surface 204 of the claws 203 and the associated bounding surface 202 of a cut-out 201 of the flange 126 is smaller than the angle beta between the median radius of one bore 127 of the flange 126 and, proceeding in the same direction of rotation, the summit or peak line of a sloping surface 140 of a clutch ball recess 141 of the driven part 132. In this way it is assured that the claws abut against the boundary surfaces of the cut-outs of the flange before the clutch balls have ascended all the way up the sloping surfaces 140 of the driven part.

With this clutch arrangement, if the automatic motor turn-off arrangement is deactivated in one of the ways described earlier, or in some other way, then when the threshold torque is reached the motor will not be automatically turned off; instead, the driving part will continue to turn relative to the driven part until the claws come into abutment against the bounding surfaces of the cut-outs of the flange. Thereafter, the motor will rotate the screw to be tightened, via the work tool holder and the inserted screwdriver attachment, until the increasing load torque upon the motor finally brings the motor to a stand still (stop or stall screwdriver).

It will be understood that each of the elements described above, or two or more together, may also find a useful application in other types of constructions differing from the types described above.

While the invention has been illustrated and described as embodied in a hand-held pneumatically powered screwdriver, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a power tool, particularly a power screwdriver, of the type provided with a built-in motor, particularly a pneumatic motor, in combination, motor switch means; a tool holder; a transmission connecting the motor to the tool holder, the transmission including torque-responsive clutch means operative for continually transmitting rotary motion and torque from the motor to the tool holder in a first manner when the torque being transmitted by the clutch means is below a preselected value and operative for continually transmitting rotary motion and torque from the motor to the tool holder in a distinguishable second manner when the torque being transmitted by the clutch means is above the preselected value, and including a clutch component which performs a shifting motion when the clutch means torque rises to such value; automatic torque-responsive turn-off means including a push rod and means responsive to the performance of the shifting motion by the clutch component for causing the push rod to perform a movement causing the switch means to turn off the motor; and override means activatable by the user for overriding the operation of the automatic torque-responsive turn-off means by preventing the push rod from causing the switch means to turn off the motor, whereby the user of the power tool can cause the clutch means to indefinitely transmit rotary motion and torque higher than the preselected value from the motor to the tool holder.

2. In a power tool as defined in claim 1, wherein the override means includes means settable by the user for arresting the push rod in a position keeping the motor switch means turned on.

3. In a power tool as defined in claim 1, the push rod having a collar, the override means including a depressible member, and movement of the push rod in a direction permitting the motor switch means to turn off the motor being blocked by abutment of the collar against the depressible member when the latter is in depressed position.

4. In a power tool as defined in claim 1, the motor being a pneumatic motor, the motor switch means comprising a valve located in the motor supply conduit and including a valve member, a valve seat and a valve spring biasing the member toward the seat, and the override means including a holding slider slidable by the user into a position keeping the valve member off the valve seat independently of the action of the push rod.

5. In a power tool as defined in claim 1, the motor switch means comprising a motor switch device constituting the only switch device in the motor energy supply path, so that not only motor turn-off but also motor turn-on are determined by the setting of the motor switch device.

6. In a power tool as defined in claim 1, the clutch means comprising a single clutch structure capable of transmitting torque in the two distinguishable manners, the clutch structure including a driving part and a driven part driven by the driving part but capable of at least limited rotational movement relative to the driving part in dependence upon the torque being transmitted by the clutch structure, the clutch structure furthermore including a plurality of clutch bodies, the clutch bodies being guided by one part for axial shifting movement but being incapable of circumferential travel relative to such one part, the other part of the clutch structure being provided with clutch body recesses, the clutch bodies being located in the recesses and confined intermediate such other part and the shifting clutch component, the clutch body recesses being defined by upwardly sloping surfaces such that as the torque transmitted by the clutch structure increases the clutch bodies rise out of the recesses and effect shifting of the shifting clutch component.

7. In a power tool as defined in claim 6, wherein the sloping surfaces defining the clutch body recesses are so configurated that in the aforementioned first manner of torque transmission the clutch bodies each remain in one associated clutch body recess pressing against a sloping wall of the recess whereas in the aforementioned second manner of torque transmission, the clutch bodies continually and repeatedly jump from one clutch body recess to the next thereby transmitting torque only intermittently but at a value higher than the preselected value.

8. In a power tool, particularly a power screwdriver, of the type provided with a built-in motor, particularly a pneumatic motor, in combination, motor switch means movable between on and off settings; a tool holder; a transmission connecting the motor to the tool holder, the transmission including torque-responsive clutch means operative for transmitting torque below a preselected value in a first manner and torque above the preselected value in a distinguishable second manner, the torque-responsive clutch means undergoing an automatic change of torque transmission manner in response to a rise of transmitted torque past the preselected value, automatic torqueresponsive turn-off means operative for mechanically detecting the automatic change and in response thereto moving the motor switch means from the on to the off setting; and override means activatable by the user of the power tool for overriding the operation of the automatic torque-responsive turn-off means by mechanically preventing the automatic turn-off means from turning off the motor.

9. In a power tool particularly a power screwdriver, of the type provided with a built-in motor, particularly a pneumatic motor, in combination, motor switch means; a tool holder; a transmission connecting the motor to the tool holder, the transmission including torque-responsive clutch means operative for transmitting in a first manner torque below a preselected value and in a distinguishable second manner torque above such value and including a clutch component which performs a shifting motion when the clutch torque rises to such value; automatic turn-off means including a push rod and means responsive to the performance of the shifting motion by the clutch component for causing the push rod to perform a movement causing the switch means to turn off the motor; and override means activatable by the user for preventing the push rod from causing the switch means to turn off the motor, the motor switch means comprising an activating device and a first turn-on switch device, the activating device and the first turn-on switch device being connected in series in the motor energy supply path so that both must be in turn-on setting to turn on the motor, the push-rod when it performs the aforementioned motion causing the activating device to assume the turn-off setting, the override means comprising a second turn-on switch device bypassing the activating device to effect energy supply to the motor independently of the operation of the automatic turn-off means, the motor having rightrotation and left-rotation energy supply paths, the activating device and first turn-on switch devices being arranged in the right-rotation path and the second turn-on switch device in the left-rotation path.

10. In a power tool as defined in claim 9 wherein the override means includes means for preventing the motion of the push rod from causing the activating device to turn off the motor even when energy is being supplied to the latter along the right-rotation path.

11. In a power tool as defined in claim 10, wherein the override means includes blocking means for preventing the push rod from moving out of a position in which it maintains the activating device in the turn-on setting.

12. In a power tool as defined in claim 11, the push rod having a collar, and the blocking means comprising a depressible member depressible into a position in which the member blocks the collar and thereby the push rod from moving out of such position.

13. In a power tool as defined in claim 10, the motor being a fluid-powered motor, the turn-on switch devices being valves, and the activating device being a valve comprised of a valve seat, a valve member and a valve spring urging the latter against the former, and wherein the means for preventing the motion of the push rod from causing the activating device to turn off the motor even when energy is being supplied to the motor along the rightrotation path comprises a holding slider slidable into a position holding the valve member off the valve seat independently of the action of the push rod.

14. In a power tool particularly a power screwdriver, of the type provided with a built-in motor, particularly a pneumatic motor, in combination, motor switch means; a tool holder; a transmission connecting the motor to the tool holder, the transmission including torque-responsive clutch means operative for transmitting in a first manner torque below a preselected value and in a distinguishable second manner torque above such value and including a clutch component which performs a shifting motion when the clutch torque rises to such value; automatic turn-off means including a push rod and means responsive to the performance of the shifting motion by the clutch component for causing the push rod to perform a movement causing the switch means to turn off the motor; and override means activatable by the user for preventing the push rod from causing the switch means to turn off the motor, the clutch means comprising a single clutch structure capable of transmitting torque in the two distinguishable manners, the clutch structure including a driving part and a driven part driven by the driving part but capable of at least limited rotational movement relative to the driving part in dependence upon the torque being transmitted by the clutch structure, the clutch structure furthermore including a plurality of clutch bodies, the clutch bodies being guided by one part for axial shifting movement but being incapable of circumferential travel relative to such one part, the other part of the clutch structure being provided with clutch body recesses, the clutch bodies being located in the recesses and confined intermediate such other part and the shifting clutch component, the clutch body recesses being defined by upwardly sloping surfaces such that as the torque transmitted by the clutch structure increases the clutch bodies rises out of the recesses and effect shifting of the shifting clutch component, wherein the clutch parts are so configurated that in the aforementioned first manner of torque transmission the driven part rotates relative to the driving part in response to a rise in transmitted torque over a limited range of relative rotational movement whereas in the afore-mentioned second manner of torque transmission the driven part is incapable of rotating relative to the driving part irrespective of rises in transmitted torque, wherein at least one of the clutch parts is provided with clutch claws which when the relative rotation of the driven and driving parts has progressed to the extent corresponding to transmission of torque having the preselected value engage portions of the other clutch part and thereafter prevent further relative rotation between the two clutch parts, the part of the clutch guiding the clutch bodies being provided with cut-outs having bounding surfaces and the other part of the clutch carrying the claws, with the claws moving into abutment against the bounding surfaces as the transmitted torque reaches and exceeds the preselected value.

15. In a power tool, particularly a power screwdriver, of the type provided with a built-in motor, particularly a pneumatic motor, in combination, motor switch means; a tool holder; a transmission connecting the motor to the tool holder, the transmission including torque-responsive clutch means operative for continually transmitting rotary motion and torque from the motor to the tool holder in a first manner when the torque being transmitted by the clutch means is below a preselected value and operative for continually transmitting rotary motion and torque from the motor to the tool holder in a distinguishable second manner when the torque being transmitted by the clutch means is above the preselected value, and including a clutch component which performs a shifting motion when the clutch means torque rises to such value; automatic turn-off means including a push rod and means responsive to the performance of the shifting motion by the clutch component for causing the push rod to perform a movement causing the switch means to turn off the motor; and override means activatable by the user for preventing the push rod from causing the switch means to turn off the motor, whereby the user of the power tool can cause the clutch means to indefinitely transmit rotary motion and torque higher than the preselected value from the motor to the tool holder, the motor switch means comprising an activating device and a first turn-on switch device, the activating device and the first turn-on switch device being connected in series in the motor energy supply path so that both must be in turn-on setting to turn on the motor, the push rod when it performs the aforementioned motion causing the activating device to assume the turn-off setting, the override means comprising a second turn-on switch device bypassing the activating device to effect energy supply to the motor independently of the operation of the automatic turnoff means.

16. In a power tool as defined in claim 15, the motor being a pneumatic motor, and the activating device and the first and second turn-on switch devices all being valves, the second turn-on switch device being a springbiased valve.

17. In a power tool as defined in claim 15, the second turn-on switch device bypassing both the activating device and the first turn-on switch device to effect energy supply to the motor independently of the operation of the automatic turn-off means and independently of the setting of the first turn-on switch device.

18. In a power tool, particularly a power screwdriver, of the type provided with a built-in motor, particularly a pneumatic motor, in combination, motor switch means; a tool holder; a transmission connecting the motor to the tool holder, the transmission including torque-responsive clutch means operative for continually transmitting rotary motion and torque from the motor to the tool holder in a first manner when the torque being transmitted by the clutch means is below a preselected value and operative for continually transmitting rotary motion and torque from the motor to the tool holder in a distinguishable second manner when the torque being transmitted by the clutch means is above the preselected value, and including a clutch component which performs a shifting motion when the clutch means torque rises to such value; automatic turn-off means including a push rod and means responsive to the performance of the shifting motion by the clutch component for causing the push rod to perform a movement causing the switch means to turn off the motor; and override means activatable by the user for preventing the push rod from causing the switch means to turn off the motor, whereby the user of the power tool can cause the clutch means to indefinitely transmit rotary motion and torque higher than the preselected value from the motor to the tool holder, the clutch means comprising a single clutch structure capable of transmitting torque in the two distinguishable manners, the clutch structure including a driving part and a driven part driven by the driving part but capable of at least limited rotational movement relative to the driving part in dependence upon the torque being transmitted by the clutch structure, the clutch structure furthermore including a plurality of clutch bodies, the clutch bodies being guided by one part for axial shifting movement but being incapable of circumferential travel relative to such one part, the other part of the clutch structure being provided with clutch body recesses, the clutch bodies being located in the recesses and confined intermediate such other part and the shifting clutch component, the clutch body recesses being defined by upwardly sloping surfaces such that as the torque transmitted by the clutch structure increases the clutch bodies rise out of the recesses and effect shifting of the shifting clutch component, wherein the clutch parts are so configurated that in the aforementioned first manner of torque transmission the driven part rotates relative to the driving part in response to a rise in transmitted torque over a limited range of relative rotational movement whereas in the aforementioned second manner of torque transmission the driven part is incapable of rotating relative to the driving part irrespective of rises in transmitted torque.

19. In a power tool as defined in claim 18, wherein at least one of the clutch parts is provided with clutch claws which when the relative rotation of the driven and driving parts has progressed to the extent corresponding to transmission of torque having the preselected value engage portions of the other clutch part and thereafter prevent further relative rotation between the two clutch parts.

* * * * *